US005079303A

United States Patent [19]

Ikeda et al.

[11] Patent Number: 5,079,303

[45] Date of Patent: Jan. 7, 1992

[54] SURFACE TREATMENT AGENT FOR PAPER

[75] Inventors: Tsuyoshi Ikeda, Chiba; Toshiyuki Hakata, Hiroshima; Tsugumi Ikegaya, Chiba, all of Japan

[73] Assignee: DIC-Hercules Chemicals, Inc., Tokyo, Japan

[21] Appl. No.: 378,770

[22] Filed: Jul. 12, 1989

[30] Foreign Application Priority Data

Jul. 15, 1988 [JP] Japan ..... 63-174946

[51] Int. Cl.[5] ..... C08F 20/60

[52] U.S. Cl. ..... 525/328.4; 525/344; 525/359.1; 525/385; 525/392

[58] Field of Search ..... 526/307; 525/328.4, 525/344, 359.1, 385, 392

[56] References Cited

U.S. PATENT DOCUMENTS

| | | | |
|---|---|---|---|
| 2,964,445 | 12/1960 | Daniel, Jr. | 162/168.1 |
| 3,170,901 | 2/1965 | Melamed et al. | 526/307 |
| 3,257,281 | 6/1966 | Maeder | 526/307 |
| 3,718,500 | 2/1973 | Nyquist | 526/307 |
| 4,418,175 | 11/1983 | Probst et al. | 526/312 |
| 4,7809,221 | 10/1988 | Holtmyer et al. | 525/328.4 |

FOREIGN PATENT DOCUMENTS

| | | | |
|---|---|---|---|
| 0276111 | 7/1988 | European Pat. Off. | 526/307 |
| 3002687 | 7/1981 | Fed. Rep. of Germany | 525/328.4 |
| 0025690 | 3/1978 | Japan | 525/328.4 |
| 60-141705 | 7/1985 | Japan | 526/307 |
| 876674 | 9/1961 | United Kingdom | 526/307 |

*Primary Examiner*—Joseph L. Schofer
*Assistant Examiner*—N. Sarofim
*Attorney, Agent, or Firm*—Oblon, Spivak, McCelland, Maier & Neustadt

[57] ABSTRACT

A surface treatment agent for paper comprising a quaternized product of a copolymer containing at least (a) styrene and/or a styrene derivative and (b) N,N-dialkylaminoalkyl (meth) acrylamide is disclosed. This surface treatment agent is excellent in slip prevention and sizing effect, the sizing effect not being impaired at a pH over 7.

11 Claims, No Drawings

SURFACE TREATMENT AGENT FOR PAPER

FIELD OF THE INVENTION

This invention relates to a surface treatment agent for paper, especially, to such an agent for anti-slipping treatment for paper.

BACKGROUND OF THE INVENTION

Paper is being put to increasingly diversed and specialized applications, and many attempts are made to improve paper quality by use of various kinds of quality-improving agents. However, use of such agents reduces, the friction coefficient of paper and has the disadvantage of making the paper more slippery.

Recently, paper-making has shifted away from the conventional acid paper-making method to alkaline paper-making method in which alkylketone dimer compounds are used as internal sizing agents, and it has been found that these compounds make the resulting paper slippery.

Slippery paper is troublesome to handle, since it often telescopically slips when rolled, and slides laterally when it is stacked.

Therefore, application of inorganic materials such as alumina, silica and the like on the surface of paper has been widely employed in order to roughen the surface for the prevention of slipping. However, this method causes pronounced abrasion of calendar rolls and requires constant inspection and maintenance of the equipment. Also, this method inevitably degrades the paper quality, especially the sized effect.

As surface treatment agents, an anti-slipping agent, a surface sizing agent, etc. are used as desired singly or in combination. However, when these agents are incompatible application, i.e., coating, must be carried out at different stations, which impairs efficiency of paper making.

Therefore, there is a demand for a surface-treating agent which provides paper with both antislipping property and sized property. Previously, we proposed a method for providing paper with anti-slipping property in which a cationic copolymer obtained by quaternization of a copolymer of a styrene compound and an aminoalkyl ester of acrylic acid or methacrylic acid (Japanese Laying-Open Patent Publication No.57-56598 (1982)). As surface sizing agents, property improvers, the following compounds are also disclosed in the following publications: a quaternized copolymer of styrene and nitrogen-containing vinyl monomer in U.S. Pat. No.2,964,445; a reaction product of epihalohydrin aqueous coating composition and a copolymer of a styrene compound and an aminoalkyl ester of (meth)acrylic acid in Japanese Laying-Open Patent Publication No.48-11407 (1973); and a quaternized copolymer of N,N-dimethylaminoethyl(meth)acrylate, styrene and acrylonitrile in Japanese Laying-Open Patent Publication No.56-118994(1981). However, these cationic copolymers have a defect in that they largely lose much of their sizing effect when the pH of the coating liquid is increased to 7–8 by any chemical reagent used in preparation of the coating liquid. Anionic surface-sizing agents commercially available today are not satisfactory in sizing and slip-prevention effects, either.

The purpose of the present invention is to provide a surface treatment agent for paper which has both sizing and slip-prevention effects, and are satisfactorily effective even when the pH of the coating liquid is 7 or higher.

We conducted an intensive study in search of such surface treatment agents and found that a quaternized product of a styrene/N,N-dialkylaminoalkyl(meth)acrylamide copolymer overcomes the above mentioned problems.

DISCLOSURE OF THE INVENTION

This invention provides a surface treatment agent for paper comprising a quaternized product of a copolymer containing at least (a) styrene and/or a styrene derivative and (b) N,N-dialkylaminoalkyl(meth)acrylamide.

The surface treatment agent of the present invention comprises a quaternized product of a copolymer of preferably 95–50 mole %, more preferably, 90–70 mole % of styrene and/or a styrene derivative and preferably 5–50 mole %, more preferably 10–30 mole % of N,N-dialkylaminoalkyl(meth)acrylamide; or a copolymer of 94–50 mole %, preferably 89–70 mole % of styrene or a styrene derivative 5–50 mole %, preferably 10–30 mole % of N,N-dialkylaminoalkyl(meth)acrylamide, and 1–20 mole % of another vinyl monomer.

The above-mentioned copolymers can be obtained by any known solution or block polymerization method. The quaternization can be effected by adding a quaternizing agent to a solution of the copolymer and heating the solution.

Typical examples of the styrene derivative are α-methylstyrene, vinyltoluene, chlorostyrene, chloromethylstyrene, etc. Typical examples of the N,N-dialkylaminoalkyl(meth)acrylamide are N,N-dimethylaminoethyl(meth)acrylamide, N,N-dimethylaminopropyl(meth)acrylamide, N,N-diethylaminoethyl(meth)acrylamide, N,N-diethylaminopropyl(meth)acrylamide, etc. and can be used singly or in combination.

Typical examples of the other vinyl monomers used in addition to the above-described monomers are esters of acrylic or methacrylic acid such as methyl(meth)acrylate, n-butyl(meth)acrylate, isobutyl(meth)acrylate, 2-ethylhexyl(meth)acrylate, 2-hydroxylethyl(meth)acrylate, lauryl(meth)acrylate, stearyl(meth)acrylate, etc.; esters of maleic or fumaric acid such as dibutyl maleate, dibutyl fumarate, dioctyl fumarate, etc.; vinyl acetate, acrylonitrile, etc.

Generally employed quaternizing agents can be used. Examples thereof are dimethyl sulfate, methyl chloride, allyl chloride, benzyl chloride, propylene oxide, butylene oxide, styrene oxide, epichlorohydrin, epibromohydrin, ethylene cholorohydrin, ethylene bromohydrin, etc.

These quaternizing agents can be used singly or in combination.

SPECIFIC DISCLOSURE OF THE INVENTION

The invention will now be illustrated by way of working examples. Parts and percentages referred to hereinafter are by weight unless otherwise specifically defined.

EXAMPLE 1

In a four-necked flask equipped with a stirrer, a thermometer and a reflux condenser, 78 parts styrene, 39 parts N,N-dimethylaminopropylacrylamide and 50 parts toluene were placed and 3.3 parts azo-bis-isobutyronitrile as a polymerization catalyst was added. The reaction mixture was heated to 90° C. and allowed to polymerize for 4 hours. Thereafter, 15 parts acetic acid and 558.6 parts water were added and toluene was removed by azeotropic distillation with water by heating the mixture to 90°–100° C.

To the thus obtained copolymer, 23.1 parts epichlorohydrin was added and quaternization reaction was carried out at 50° C. for 2 hours. By adjusting the concentration, a surface treatment agent containing 20% nonvolatile content was obtained.

EXAMPLE 2

The procedure of Example 1 was repeated using 88.4 parts styrene, 23.4 parts N,N-dimethylaminopropylacrylamide, 9.0 parts acetic acid and 13.9 parts epichlorohydrin as a quaternizer, and a surface treatment agent was obtained.

EXAMPLE 3

The procedure of Example 1 was repeated using 72.8 parts styrene, 31. parts N,N-dimethylaminopropylacrylamide, 11.8 parts vinyltoluene, 12 parts acetic acid and 18.5 parts epichlorohydrin as a quaternizer and a surface treatment agent was obtained.

EXAMPLE 4

The procedure of Example 1 was repeated using 72.8 parts styrene, 25.5 parts N,N-dimethylaminopropyl(meth)acrylamide, 21.3 parts isobutylmethacrylate, 9.0 parts acetic acid and 13.9 parts epichlorohydrin and a surface treatment agent was obtained.

EXAMPLE 5

The procedure of Example 1 was repeated using 78 parts styrene, 39 parts N,N-dimethylaminopropylacrylamide, 12 parts acetic acid and 18 parts butylene oxide as a quaternizer and a surface treatment agent was obtained.

EXAMPLE 6

The procedure of Example 1 was repeated using 83.2 parts styrene, 31.2 parts N,N-dimethylaminopropylacrylamide, 12 parts acetic acid and 25.2 parts dimethyl sulfate as a quaternizer and a surface treatment agent was obtained.

EXAMPLE 7

The following tests were carried out in order to evaluate the effects of the surface treatment agents obtained in Examples 1–6 and commercially available products as comparative agents.

EVALUATION 1

The surface of commercially available kraft liner test paper which was internally sized with an alkylketone dimer compound was coated with the surface treatment agents of Examples 1–6, a commercially available cationic sizing agent A (a reaction product of styrene/N,N-dialkylamino(meth)acrylate-epichlorohydrin) and a commercially available anionic sizing agent B (copolymer of styrene-acryl acid) under the condition of paper surface pH of 6.4 (neutral liner). The coating was carried out as follows. Coating liquids were prepared so that the resulting coating weight would be 0.05g/m$^2$, (solid content). The coating liquids were applied on the test paper by a laboratory scale size press (manufactured by Kumagai Riki Kogyo K.K.) and dried by a drum drier at 100° C. for 30 seconds. After conditioned in a chamber of constant temperature of 20° C. and constant humidity of 65% for 24 hours, Cobb sizing degree and sliding angle of the surface treated paper were measured. The results are shown in Table 1. The Cobb sizing degree was measured in accordance with JIS P-8140. The lower the number, the better the effect. The sliding angle was measured in accordance with the inclination method stipulated in JIS P-8147. The sliding angles after paper had been slid 1 time, 5 times and 10 times, are shown in Table 1. The larger the numerical value, the better the effect.

TABLE 1

| | Effect For Neutral Liner | | | | | | | | |
|---|---|---|---|---|---|---|---|---|---|
| | | | | | | | Comparative Example | | |
| Surface | Example | | | | | | Commercial | Commercial | Uncoated |
| Treatment Agent | 1 | 2 | 3 | 4 | 5 | 6 | Product A | Product B | Base Paper |
| Cobb Sizing Degree 2 min. (g/m$^2$) | 20.5 | 23.7 | 22.5 | 26.2 | 25.5 | 25.3 | 35.0 | 35.4 | 168 |
| Sliding Angle | | | | | | | | | |
| 1st Time | 22.2 | 22.8 | 22.0 | 21.7 | 22.1 | 22.8 | 20.2 | 19.8 | 16.7 |
| 5th Time | 22.0 | 22.5 | 21.7 | 21.2 | 21.7 | 22.5 | 19.8 | 19.5 | 15.7 |
| 10th Time | 21.0 | 21.7 | 21.5 | 20.5 | 21.6 | 21.9 | 18.7 | 18.2 | 14.0 |

Commercial Product A: A reaction product of styrene/N,N-dialkylamino(meth)acrylate-epichlorohydrin
Commercial Product B: Copolymer of styrene and acrylic acid

EVALUATION 2

The procedure of Evaluation 1 was repeated using B-grade liner test paper acidic liner, with a surface pH of 4.2. The results are shown in Table 2.

TABLE 2

| | Effect For Acidic Liner | | | | | | | | |
|---|---|---|---|---|---|---|---|---|---|
| | | | | | | | Comparative Example | | |
| Surface | Example | | | | | | Commercial | Commercial | Uncoated |
| Treatment Agent | 1 | 2 | 3 | 4 | 5 | 6 | Product A | Product B | Base Paper |
| Cobb Sizing Degree 2 min. (g/m$^2$) | 21.0 | 21.7 | 21.5 | 21.4 | 22.2 | 22.2 | 37.5 | 22.8 | 253 |
| Sliding Angle | | | | | | | | | |
| 1st Time | 22.0 | 22.5 | 22.3 | 22.1 | 21.7 | 21.8 | 21.2 | 19.3 | 17.2 |
| 5th Time | 21.8 | 22.0 | 22.2 | 22.1 | 21.5 | 21.5 | 21.0 | 19.0 | 14.0 |

TABLE 2-continued

| Surface Treatment Agent | Effect For Acidic Liner | | | | | | | | |
|---|---|---|---|---|---|---|---|---|---|
| | Example | | | | | | Comparative Example | | Uncoated Base Paper |
| | 1 | 2 | 3 | 4 | 5 | 6 | Commercial Product A | Commercial Product B | |
| 10th Time | 21.5 | 21.7 | 21.8 | 22.0 | 21.5 | 21.2 | 20.5 | 18.0 | 14.0 |

EVALUATION 3

The procedure of Evaluation 2 was repeated using a coating liquid which had been kept at 50° C. for 5 hours after the pH thereof was adjusted to 8.0. This test was carried out as a simulation of a practical commercial operation. That is, the surface treatment agent was tested with the pH of the coating liquid being raised by addition of another additive and the coating liquid being recirculated over a period of several hours. The results are shown in Table 3.

TABLE 3

| Surface Treatment Agent | pH Stability | | | | | | | |
|---|---|---|---|---|---|---|---|---|
| | Example | | | | | | Comparative Example | |
| | 1 | 2 | 3 | 4 | 5 | 6 | Commercial Product A | Commercial Product B |
| pH of Coating Liquids | 8.0 | 8.0 | 8.0 | 8.0 | 8.0 | 8.0 | 8.0 | 8.0 |
| pH Before Adjustment | 6.2 | 6.3 | 6.4 | 6.3 | 6.7 | 6.5 | 4.5 | 8.0 |
| Cobb Sizing Degree 2 min. ($g/m^2$) | 20.5 | 20.8 | 21.1 | 21.0 | 22.5 | 22.0 | 50.2 | 23.2 |
| Sliding Angle | | | | | | | | |
| 1st Time | 21.5 | 22.7 | 22.0 | 21.6 | 21.7 | 21.6 | 20.5 | 19.4 |
| 5th Time | 21.3 | 22.5 | 21.9 | 21.2 | 21.3 | 21.4 | 20.1 | 19.2 |
| 10th Time | 21.0 | 21.8 | 21.5 | 21.0 | 21.0 | 21.3 | 19.8 | 18.9 |

The surface treatment agent for paper of the present invention has excellent slip prevention and sizing effects and its sizing effect is not impaired at a pH over 7.

What is claimed is:

1. A surface treatment agent for paper, comprising a copolymer prepared by (I) polymerizing a mixture comprising (a) 95–50 mole % of at least one aromatic monomer selected from the group consisting of styrene and styrene derivatives; and (b) 5–50 mole % of at least one N,N-di(alkyl-)amino-(alkyl) (meth)acrylamide, and (II) quaternizing the polymerization product with a quaternizing agent.

2. The surface treatment agent of claim 1, wherein said mixture comprises 90–70 mole % of said aromatic monomer, and 10–30 mole % of said N,N-di(alkyl-)amino(alkyl) (meth)acrylamide.

3. The surface treatment agent of claim 1, wherein said mixture further comprises 1–20 mole % of at least one vinyl monomer selected from the group consisting of $C_{1-18}$ esters of (meth)acrylic acid, 2-hydroxylethyl (meth)acrylate, di-$C_{1-8}$ acetate and acrylonitrile; and 94–50 mole % of said aromatic monomer is present.

4. The surface treatment agent of claim 3, wherein 89–70 mole % of said aromatic monomer, and 10–30 mole % of said N,N-di(alkyl)amino(alkyl) (meth)acrylamide are present.

5. The surface treatment agent of claim 1, wherein said aromatic monomer is selected from the group consisting of styrene, α-methylstyrene, vinyltoluene, chlorostyrene and chloromethylstyrene.

6. The surface treatment agent of claim 1, wherein said quaternizing agent is selected from the group consisting of dimethyl sulfate, methyl chloride, allyl chloride, benzyl chloride, propylene oxide, butylene oxide, styrene oxide, epichlorohydrin, epibromohydrin, ethylene cholorohydrin and ethylene bromohydrin.

7. The surface treatment agent of claim 5, wherein said quaternizing agent is selected from the group consisting of dimethyl sulfate, methyl chloride, allyl chloride, benzyl chloride, propylene oxide, butylene oxide, styrene oxide, epichlorohydrin, epibromohydrin, ethylene cholorohydrin and ethylene bromohydrin.

8. The surface treatment agent of claim 7, wherein said mixture further comprises 1–20 mole % of at least one vinyl monomer selected from the group consisting of $C_{1-18}$ esters of (meth)acrylic acid, 2-hydroxylethyl (meth)acrylate, di-$C_{1-8}$ esters of maleic acid, di-$C_{1-8}$ esters of fumaric acid, vinyl acetate and acrylonitrile; and 94–50 mole % of said aromatic monomer is present.

9. The surface treatment agent of claim 1, wherein said N,N-di(alkyl)amino(alkyl) (meth)acrylamide is selected from the group of N,N-dimethylaminoethyl(-meth)acrylamide, N,N-dimethylaminopropyl(meth)acrylamide, N,N-diethylaminoethyl(meth)acrylamide and N,N-diethylaminopropyl(meth)acrylamide.

10. The surface treatment agent of claim 7 wherein said N,N-di(alkyl)amino(alkyl) (meth)acrylamide is selected from the group consisting of N,N-dimethylaminoethyl (meth)-acrylamide, N,N-dimethylaminopropyl(meth)acrylamide, N,N-diethylaminoethyl(meth)acrylamide and N,N-diethylaminopropyl-(meth)acrylamide.

11. The surface treatment agent of claim 8, wherein said N,N-di(alkyl)amino(alkyl) (meth)acrylamide is selected from the group consisting of N,N-dimethylaminoethyl (meth)-acrylamide N,N-dimethylaminopropyl(meth)acrylamide, N,N-diethylaminoethyl (meth)acrylamide and N,N-diethylaminopropyl-(meth)acrylamide.

* * * * *

UNITED STATES PATENT AND TRADEMARK OFFICE

CERTIFICATE OF CORRECTION

PATENT NO. : 5,079,303

DATED : January 7, 1992

INVENTOR(S) : Tsuyoshi Ikeda et al.

It is certified that error appears in the above-identified patent and that said Letters Patent is hereby corrected as shown below:

On the title page, in item [21] Appl. No.: change "378,770" to read as --378,779--.

Signed and Sealed this

Fourth Day of May, 1993

*Attest:*

Michael K. Kirk

MICHAEL K. KIRK

*Attesting Officer*

*Acting Commissioner of Patents and Trademarks*

UNITED STATES PATENT AND TRADEMARK OFFICE

CERTIFICATE OF CORRECTION

PATENT NO. : 5,079,303

DATED : January 7, 1992

INVENTOR(S) : Tsuyoshi Ikeda, et al.

It is certified that error appears in the above-indentified patent and that said Letters Patent is hereby corrected as shown below:

Column 1, line 18: "alkylketone" should read --alkylketene--.

Column 3, line 18: "31. parts" should read --31.2 parts--.

Column 4, line 12: "alkylketone" should read --alkylketene--.

Column 5, line 57: di-$C_{1-8}$ acetate" should read --di-$C_{1-8}$ esters of maleic acid, di-$C_{1-8}$ esters of fumaric acid, vinyl acetate--.

Column 6, line 16: "chlorohydrin" should read --chlorohydrin--;

line 46: "dimethylaminoethyl(-" should read --dimethylaminoethyl- --;

line 47: meth)acrylamide" should read --(meth)acrylamide--;

UNITED STATES PATENT AND TRADEMARK OFFICE

CERTIFICATE OF CORRECTION

PATENT NO. : 5,079,303

DATED : January 7, 1992

INVENTOR(S) : Tsuyoshi Ikeda, et al.

It is certified that error appears in the above-indentified patent and that said Letters Patent is hereby corrected as shown below:

line 53: "thylaminoethyl (meth)-acrylamide" should read --thylaminoethyl(meth)acrylamide--.

Signed and Sealed this

Fifteenth Day of March, 1994

*Attest:*

*Attesting Officer*

BRUCE LEHMAN

*Commissioner of Patents and Trademarks*